US005896826A

United States Patent [19]

Winer

[11] Patent Number: 5,896,826

[45] Date of Patent: Apr. 27, 1999

[54] ADJUSTABLE CABLE MARKER

[76] Inventor: Robert Winer, 835 Cranberry La., Akron, Ohio 44313

[21] Appl. No.: 08/760,684

[22] Filed: Dec. 4, 1996

Related U.S. Application Data

[60] Provisional application No. 60/008,193, Dec. 5, 1995.

[51] Int. Cl.[6] ..... H01B 7/36

[52] U.S. Cl. ..... 116/200; 174/112; 138/168; 24/580

[58] Field of Search ..... 116/200; 174/68.3, 174/112; 138/162, 166, 167, 168; 24/576, 580, 20 EE, 20 CW, 22 W, 20 R

[56] References Cited

U.S. PATENT DOCUMENTS

| | | | |
|---|---|---|---|
| 2,198,415 | 4/1940 | Quarnstrom | 138/168 |
| 3,161,210 | 12/1964 | Loof | 138/166 |
| 3,242,948 | 3/1966 | Dunn | 138/166 |
| 3,495,306 | 2/1970 | Eichberg | 24/576 |
| 3,503,426 | 3/1970 | MacMillan et al. | 138/168 |
| 3,682,163 | 8/1972 | Plummer | 138/168 |
| 3,785,337 | 1/1974 | Flowerday | 116/209 |
| 4,234,090 | 11/1980 | Barbieri | 206/459 |
| 4,415,006 | 11/1983 | Barbieri | 138/115 |
| 4,742,796 | 5/1988 | Halsey | 116/209 |
| 5,126,507 | 6/1992 | Kimra | 74/68.3 |
| 5,224,440 | 7/1993 | Cox | 116/209 |
| 5,280,765 | 1/1994 | Segerstrom | 116/209 |
| 5,372,335 | 12/1994 | Yentzer | 244/33 |
| 5,425,328 | 6/1995 | Larumbe | 116/209 |
| 5,467,730 | 11/1995 | Kovaletz | 116/209 |

OTHER PUBLICATIONS

Scoll type cable marker (date & author unknown).

*Primary Examiner*—Diego Gutierrez
*Assistant Examiner*—Andrew Hirshfeld
*Attorney, Agent, or Firm*—Oldham & Oldham Co., L.P.A.

[57] ABSTRACT

A cable marker used to identify associated cables. The cable marker is made of a weatherable polymeric material which remains flexible in variable temperature conditions. The cable marker is substantially elliptically shaped allowing the marker to adjust to fit cables of varying diameter. The cable marker has a plurality of sizing lugs and a diametrically opposed locking lug to facilitate sizing and locking of the cable marker to the cable. Engraving and foil printing permanently identify cables in addition to color coding.

8 Claims, 2 Drawing Sheets

ADJUSTABLE CABLE MARKER

This application claim benefit of Provisional application 60/008,193 filed Dec. 5, 1995.

TECHNICAL FIELD

This invention relates to a marking apparatus for identification of cables and more particularly to an adjustable cable marking apparatus for improved handling, placement and identification of cables.

BACKGROUND OF THE INVENTION

As the communications industry adjusts to advances in cable materials, the need has arisen for cable marking devices which are capable of indicating the type of cable being used. Advances in fiber optic technology have lead to the replacement of conventional wire cable in a number of applications. Upgrading current wire cable systems often requires those handling the cable systems to be able to differentiate between conventional cables and cables composed of newer materials. Fiber Optic cable must be handled differently than wire cable, therefore, a caution/identification marker must be placed at every junction or support position encountered by a service technician.

The current industry standard in cable markers is a plastic scroll-type device. While this scroll marker does identify the cable, it is difficult to use and displays only a modest amount of safety coloring. Attaching the currently used marker requires the technician to unravel a tightly scrolled plastic sheet in order to fit it over the wire. Fitting such a marker over a wire is made more difficult in cold weather when the technician is often wearing gloves and in situations where the technician only has one hand available for manipulating the marker. In the past, markers have been available in only one color, typically a variation of burnt orange, making the distinguishing of different types of cables troublesome.

The present invention meets the needs of the communications industry in differentiating cable according to type with a cable marker capable of simple attachment which is available in a variety of colors for distinguishing between the increasingly diverse materials being used in communications cables.

SUMMARY OF THE INVENTION

It is an object of the present invention to provide a convenient marking device for cables which is adjustable to a variety of cable diameters and capable of accommodating multiple cables. It is a further object of the invention to provide a cable marker in a variety of colors for distinguishing between cable types and/or sizes.

The preferred embodiment comprises an elongated elliptical plastic or polymeric band, having an asymmetrical cross section, which is placed around the diameter of a cable and then locked into position. Locking is accomplished by ratcheting a locking lug into one of a plurality of corresponding sizing lugs according to the diameter of the cable, thereby allowing the marker to be used for a variety of cable sizes. The angles on the sizing and locking lugs cooperate to secure the marker once placed around the diameter of the cable. The band thickness must be such that the marker easily forms around the cable. In order to accommodate the curvature present in most cables, the locking lugs cooperate with the sizing lugs to permit a snug fit which holds the marker in place without requiring a precision fit.

The elliptical shape is necessary to eliminate interference between the inside wall of the locking lug and the outside surface of the sizing lug wall. The sizing lug wall must easily move inward to match the diameter of the cable. The elongated elliptical band is formed by extrusion using a relieved die and several forming plates. It is preferable to extrude in this manner to maintain a consistent flow of marker material. The currently preferred marker material is a weatherable polypropylene, EPDM or other appropriate polymer which will remain flexible in variable temperature conditions.

The marker coloring is made weather proof with ultraviolet stabilizers which resist severe color fading. Further identifying characteristics can be incorporated by debossing or engraving the polymer resin with appropriate caution and/or identification markings.

DETAILED DESCRIPTION OF THE PREFERRED EMBODIMENT

Figure 1:
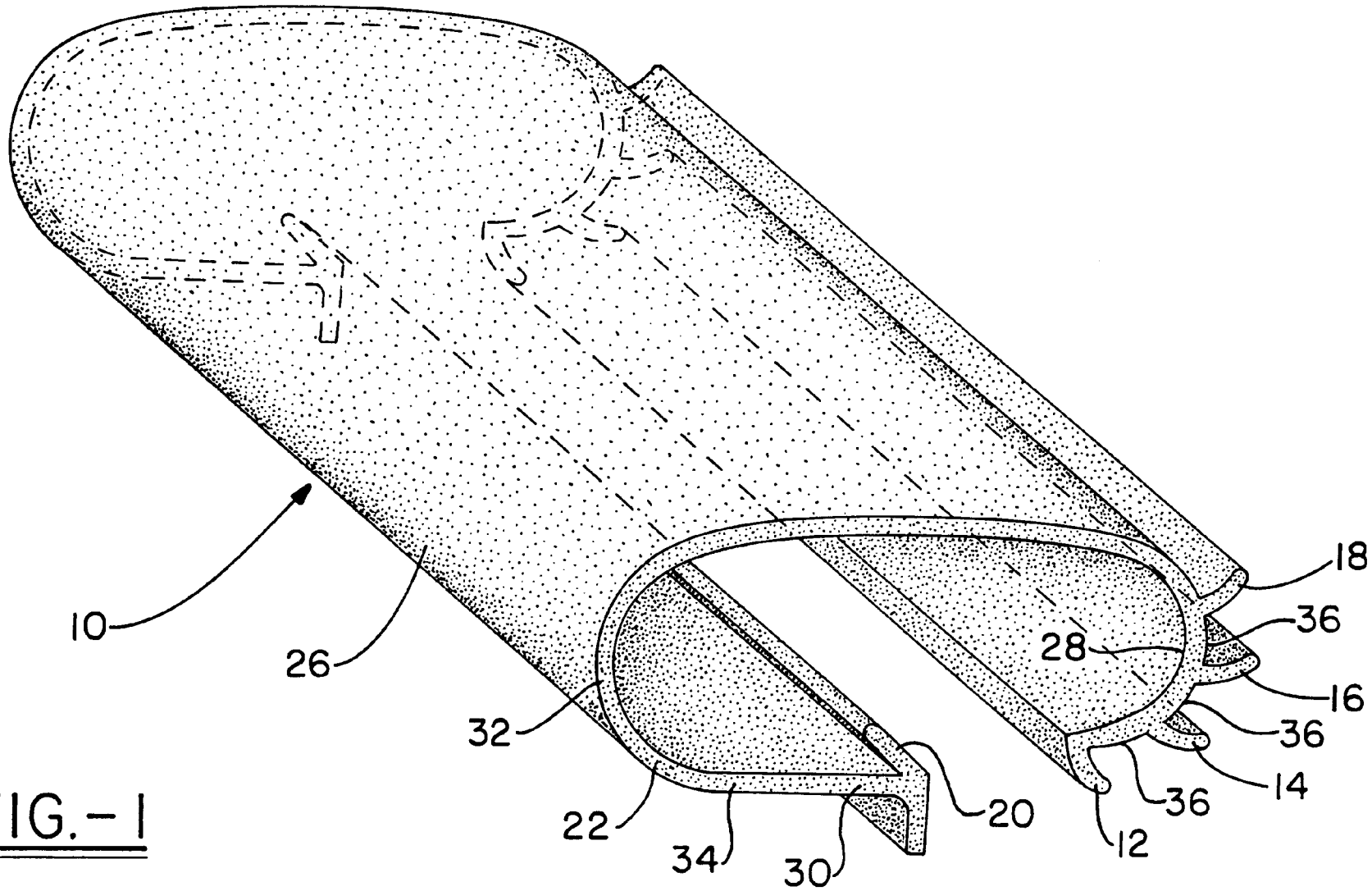
FIG. 1 is a view in perspective of the preferred embodiment of the cable marker with the sizing lugs and locking lug running parallel with the elongate axis.

With reference to FIG. 1, cable marker 10 comprises an elongated body 26 of substantially elliptical cross section with an inner surface and an outer surface. A longitudinal opening is cut along the length of elongated body 26 which allows the marker 10 to be fit over a cable. Sizing lugs 12, 14, 16, and 18 are preferably disposed along the outer surface of marker thereby defining a sizing region beginning at one edge of the longitudinal opening and extending around a portion of the outer surface of first elliptical wall 28. At least one locking lug preferably extends from the inner surface of marker 20 thereby defining a locking region beginning at the opposite edge of the longitudinal opening and extending around a portion of the inner surface of second elliptical wall 32. That portion of the surface of the marker comprising the locking and sizing regions is approximately 25% of the total marker surface, respectively. In an alternative embodiment of the invention, the surfaces of the locking and sizing regions are reversed so that the locking lug is disposed on the outer surface of first elliptical wall 28 and the sizing lugs are disposed on the inner surface of second elliptical wall 32.

Figure 2:
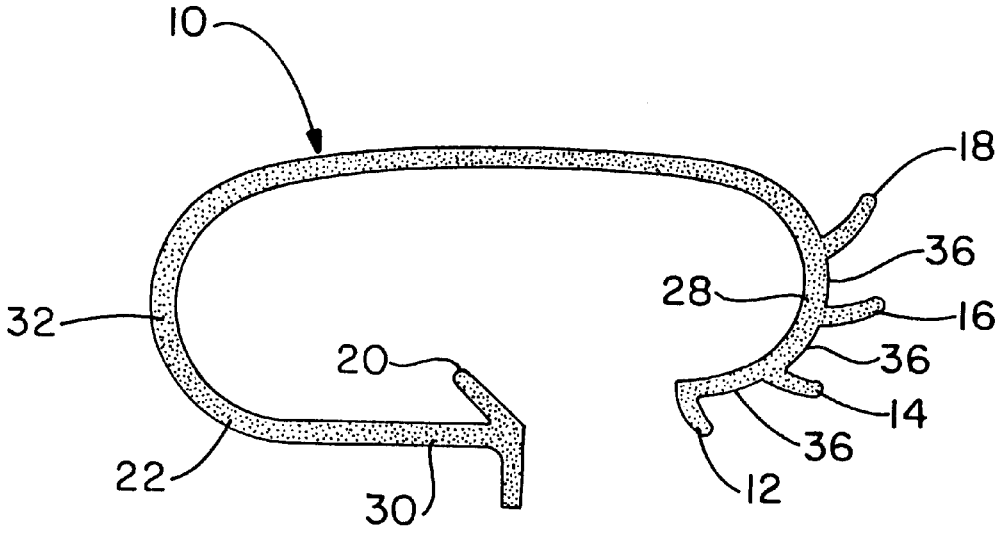
FIG. 2 is an end view of the cable marker shown in FIG. 1.
Figure 3:
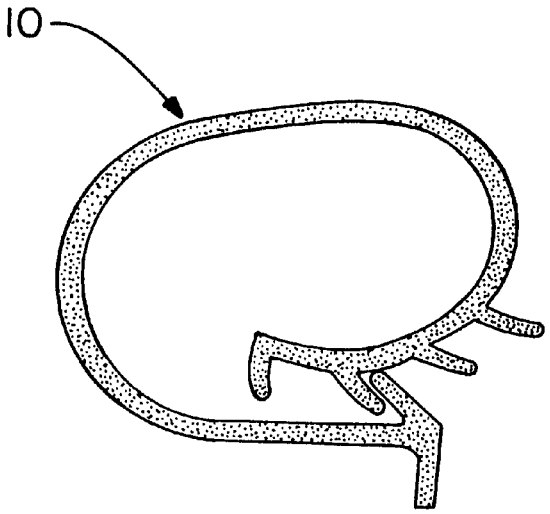
FIG. 3 is an end view of the cable marker shown in FIG. 1 in a locked position.

The configuration of sizing lugs 12, 14, 16, and 18 is shown in cross-section in FIG. 2 taken from end 22. In the preferred embodiment, sizing lugs are spaced evenly from one another along the outer surface of first elliptical wall 20 and are preferably graduated in height from first sizing lug 12 to fourth sizing lug 18. In their preferred embodiment, sizing lugs 12, 14, 16, and 18 curve in a counterclockwise direction away from the longitudinal opening and locking lug 20. Corresponding locking lug 20 is positioned at an angle, preferably 45 degrees, with inside wall 30 of second elliptical wall 32 so as to facilitate locking when locking lug 20 engages a sizing lug. It is also to be understood that at least one locking lug and any number of sizing lugs could be used to offer a greater variety of sizing capabilities or smaller variations between sizes.

The preferred method of attaching cable marker 10 is to position cable marker 10 around the diameter of a cable and slidably ratchet at least one locking lug 20 over the plurality of sizing lugs 12, 14, 16, and 18 until a secure fit is achieved. The presence of the cable serves to reinforce locking by forcing and maintaining first elliptical wall 28 against second elliptical wall 32 so that the locking and sizing lugs better conform to one another. The preferred marker material is flexible, however, the extrusion process used to form the marker (see below) confers upon the marker a memory which causes the device to lock as it tries to return to its original shape. The presence of the extruded lugs provides additional longitudinal structural support to the band so that the regions of the band comprising the sizing and locking regions are substantially more resistant to deformation than the remaining marker body. The elliptical shape is preferred to a circular shape in order to eliminate interference between inside wall 34 of at least one locking lug 20 and outside surface 36 of sizing lugs 12, 14, 16, or 18. It is also to be understood that cable markers having non-elliptical, cross-sectional shapes which avoid such interference are also contemplated as within the scope of the invention.

Cable marker 10 is formed longitudinally preferably through extrusion using a relieved die and multiple forming plates. A polymeric material and an appropriate coloring additive is charged into the extrusion apparatus and the product is extruded. The marker is preferably made of a weatherable thermoplastic or thermoset material (polypropylene or EPDM, respectively) which remains flexible in variable temperature conditions. A variety of coloring additives may be incorporated into the material to be extruded including an ultra-violet stabilizer which prevents the coloring from fading. In the preferred embodiment, cable marker 10 is orange, yellow, white or green all of which can be easily distinguished from variable distances. In addition, cable marker At can be permanently embossed or engraved in a manner which preserves the associated cable's identity in the event cable marker 10 is used for marking underground cables. In the preferred embodiment, cable marker 10 can be cut to variable lengths to accommodate variable amounts of embossed or engraved text. Common applications require a 4–8 inch marker.

Whereas this invention is illustrated and described with particular emphasis on the preferred embodiment, other embodiments apparent to those of ordinary skill in the art are also within the scope of the invention. Accordingly, the scope of the invention is intended to be defined by the claims as defined by the specification and drawings.

What is claimed is:

1. A cable marker, comprising:

an elongate band having a first and a second end, said band in cross section having an opening flanked by a locking region and a sizing region;

a locking lug positioned on said locking region; and a plurality of sizing lugs positioned on said sizing region for engaging said locking lug, wherein said plurality of sizing lugs are graduated in height such that the sizing lug nearest the opening is the shortest.

2. The cable marker recited in claim 1, wherein said cross section is substantially elliptical.

3. The cable marker as recited in claim 1, further comprising at least one additional locking lug positioned on said locking region.

4. The cable marker recited in claim 1, wherein said locking lug is angled away from said opening so as to facilitate locking when engaging said plurality of sizing lugs.

5. The cable marker recited in claim 4, wherein said locking lug makes a 45 degree angle with said band.

6. The cable marker recited in claim 1, wherein said plurality of sizing lugs are spaced apart from one another along said sizing region.

7. The cable marker recited in claim 1, wherein said plurality of sizing lugs are curved in a direction away from said opening.

8. A method of marking a cable with a marker having aN elongate band with a first and a second end, said band in cross section having an opening cut along its length flanked by a locking region and a sizing region; At least one locking lug positioned on said locking region of said opening; and a plurality of sizing lugs spaced along said sizing region of said opening, wherein said plurality of sizing lugs are graduated in height such that the sizing lug nearest the opening is the shortest, comprising the steps of:

a) fitting said band around said cable; aNd b) slidably ratcheting said locking lug over said plurality of sizing lugs until a secure fit is achieved.

* * * * *